US008347665B2

(12) United States Patent
Rasmussen et al.

(10) Patent No.: US 8,347,665 B2
(45) Date of Patent: Jan. 8, 2013

(54) SELF-BALANCING LOCKING MECHANISM FOR DOORS

(75) Inventors: Terry D. Rasmussen, Payson, UT (US); Richard C. O'Neal, Payson, UT (US)

(73) Assignee: Liberty Safe and Security Products, Inc., Payson, UT (US)

( * ) Notice: Subject to any disclaimer, the term of this patent is extended or adjusted under 35 U.S.C. 154(b) by 478 days.

(21) Appl. No.: 12/749,114

(22) Filed: Mar. 29, 2010

(65) Prior Publication Data

US 2011/0174025 A1 Jul. 21, 2011

Related U.S. Application Data

(60) Provisional application No. 61/295,926, filed on Jan. 18, 2010.

(51) Int. Cl.
*E05B 65/00* (2006.01)

(52) U.S. Cl. ..... 70/91; 70/114; 70/118; 70/149; 109/59 R; 292/7; 292/34; 292/36; 292/40

(58) Field of Classification Search ..... 70/114–116, 70/118–120, 149; 292/7, 34, 36, 40, 68; 109/59 R See application file for complete search history.

(56) References Cited

U.S. PATENT DOCUMENTS

| | | | | | |
|---|---|---|---|---|---|
| 1,046,438 | A | * | 12/1912 | Caldwell | 70/358 |
| 1,559,160 | A | | 10/1925 | Carter | |
| 2,875,918 | A | | 3/1959 | Baumier | |
| 3,598,462 | A | | 8/1971 | Kanitz | |
| 3,745,796 | A | | 7/1973 | Fleming | |
| 3,834,780 | A | | 9/1974 | McClellan et al. | |
| 4,154,070 | A | * | 5/1979 | Bahry et al. | 70/108 |
| 4,362,034 | A | * | 12/1982 | Amgar | 70/108 |
| 4,470,277 | A | * | 9/1984 | Uyeda | 70/118 |
| 4,639,021 | A | | 1/1987 | Hope | |
| 4,679,415 | A | * | 7/1987 | Spratt | 70/118 |
| 5,784,973 | A | * | 7/1998 | Mercer et al. | 109/59 R |
| 6,089,168 | A | * | 7/2000 | Dunlap et al. | 109/59 R |
| 6,679,087 | B2 | * | 1/2004 | Suggs et al. | 70/153 |
| 7,464,570 | B1 | * | 12/2008 | Chen | 70/267 |
| 8,056,941 | B2 | * | 11/2011 | Segev et al. | 292/21 |
| 2007/0046032 | A1 | * | 3/2007 | Moore | 292/36 |

OTHER PUBLICATIONS

Liberty Safe—Bolt Brackets & Anti-pry Tabs are Installed, 2 pages. Applicant believes that this product was offered for sale prior to the filed of applicant's application. Liberty Safe—The Heart of Liberty's Security is our Mechanism, 2 pages. Applicant believes that this product was offered for sale prior to the filed of applicant's application.

* cited by examiner

*Primary Examiner* — Suzanne Barrett
(74) *Attorney, Agent, or Firm* — Thorpe North & Western LLP

(57) ABSTRACT

A self-balancing locking mechanism for actuating a locking pin-bar assembly of a door. The mechanism includes a drive shaft having an axis of rotation mounted to the door, and a cam mounted to the drive shaft. The mechanism also includes one or more actuator plates, each having a proximal end with a radial slot formed therein and installed about the drive shaft, and a distal end coupled to a locking pin-bar assembly that is slidably supported adjacent a perimeter of the door. The mechanism further includes one or more linkage bars, each having a proximal end pivotably coupled to the cam at a radial distance from the axis of rotation, and a distal end pivotably coupled to a mid-span of the actuator plate. Rotation of the cam causes the linkage bar to drive the actuator plate along a radial axis and engage the locking pin-bar assembly with a side edge of a door frame, and simultaneously cause the radial slot of the actuator plate to bear on the drive shaft and balance any off-axis loads applied by the linkage bar to the actuator plate.

20 Claims, 7 Drawing Sheets

SELF-BALANCING LOCKING MECHANISM FOR DOORS

RELATED APPLICATIONS

This application claims the benefit of U.S. Provisional Patent Application No. 61/295,926, filed Jan. 18, 2010, and entitled "Self-Balancing Locking Mechanism for Doors," which application is incorporated by reference in its entirety herein.

FIELD OF THE INVENTION

The field of the invention relates generally to locking mechanisms for doors, and more specifically for locking mechanisms used to actuate pin-bar assemblies installed into the doors of high-security enclosures such as safes.

BACKGROUND OF THE INVENTION AND RELATED ART

When securing the door of a safe or other security enclosure, it is important to ensure that each possible method for opening the safe is guarded against unauthorized entry. In attempts to accomplish this, numerous different methods have been developed for ensuring that the door of the safe may not be easily opened, as the door is often the most vulnerable portion of the safe. If a burglar, thief or vandal is able to pry the door of the safe open, the structural integrity of the remainder of the safe or security enclosure becomes irrelevant. In attempts to overcome this concern, numerous arrangements have been made which cause a plurality of locking bolts or pins to extend from one or more sides of the door and into the remainder of the safe so as to prevent the door from being opened by prying, punching or some other externally-applied force.

While the use of locking bolts improves the security of the door, the present arrangements for engaging the locking bolts often provide insufficient protection, are difficult to operate, or are overly expensive. Other systems provide adequate protection, but are needlessly complex and have numerous moving parts which interact together in a rough or inefficient manner. If the parts fail, moreover, the owner of the safe may be unable to retrieve his or her belongings without unnecessary delay and the possibility of destroying the safe.

Thus, a need continues to exist for simple, efficient and more cost-effective locking mechanisms and methods for engaging the locking bolts on a safe door with the remainder of the safe. Such mechanisms would minimize the number of moving parts and improve their efficiency and smoothness during operation while continuing to provide secure protection against the door of the safe being opened without authorization.

SUMMARY OF THE INVENTION

In accordance with one representative embodiment described herein, a self-balancing locking mechanism is provided for actuating a locking pin-bar assembly of a door of a security enclosure, such as the door of a safe. The locking mechanism includes a drive shaft having an axis of rotation mounted to the door, and a cam mounted to the drive shaft. The mechanism also includes one or more actuator plates, each having a proximal end with a radial slot formed therein and installed about the drive shaft, and a distal end coupled to a locking pin-bar assembly that is slidably supported adjacent a perimeter of the door. The mechanism further includes one or more linkage bars, each having a proximal end pivotably coupled to the cam at a radial distance from the axis of rotation, and a distal end pivotably coupled to a mid-span of an actuator plate. Rotation of the cam causes the linkage bar to drive the actuator plate along a radial axis and engage the pin-bar assembly with a side edge of a door frame, and causes the radial slot to bear on the drive shaft and balance any off-axis loads applied by the linkage bar to the actuator plate.

In accordance with another representative embodiment described herein, an internally-balanced locking mechanism is provided for securing a door of a safe. The locking mechanism includes a drive shaft having an axis of rotation mounted to the door of the safe, and a cam mounted to the drive shaft. The mechanism also includes two or more actuator plates, each actuator plate having a proximal end with a lateral slot formed therein and installed about the drive shaft, and a distal end coupled to opposing locking pin-bar assemblies that are slidably supported adjacent a perimeter of the door of the safe. The mechanism further includes two or more linkage bars, with each linkage bar having a proximal end pivotably coupled to the cam at a radial distance from the axis of rotation, and a distal end pivotably coupled to a mid-span of one of the actuator plates. Rotation of the cam causes the linkage bars to drive the actuator plates in opposite directions along a horizontal radial axis and engage the pin-bar assemblies with opposite vertical side edges of a door frame of the safe, and simultaneously causes the lateral slots of the actuator plates to bear on the drive shaft and balance any off-axis loads applied by the linkage bars to the actuator plates.

In accordance with yet another representative embodiment described herein, a method is provided for actuating a locking pin-bar assembly of a door to engage with a door frame. The method includes the step of rotating a drive shaft mounted to the door in a first direction, with the drive shaft having an axis of rotation and a rotatable cam coupled thereto. The method also includes the step of causing a linkage bar to drive an actuator plate along a radial axis and engage the locking pin-bar assembly with a vertical or horizontal side edge of the door frame, wherein the linkage bar has a proximal end pivotably coupled to the cam at a radial distance from the axis of rotation and a distal end pivotably coupled to a mid-span of the actuator plate, and wherein the actuator plate has a distal end coupled to the locking pin-bar assembly that is slidably supported adjacent a perimeter of the door. The method further includes the step of causing a radial slot formed into a proximal end of the actuator plate to bear on the drive shaft and balance any off-axis loads applied by the linkage bar to the actuator plate.

BRIEF DESCRIPTION OF THE DRAWINGS

Features and advantages of the present invention will be apparent from the detailed description that follows, and when taken in conjunction with the accompanying drawings together illustrate, by way of example, features of the invention. It will be readily appreciated that these drawings merely depict representative embodiments of the present invention and are not to be considered limiting of its scope, and that the components of the invention, as generally described and illustrated in the figures herein, could be arranged and designed in a variety of different configurations. Nonetheless, the present invention will be described and explained with additional specificity and detail through the use of the accompanying drawings, in which.

DETAILED DESCRIPTION OF EXEMPLARY EMBODIMENTS

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description and representative embodiments will best understood with reference to the accompanying drawings, wherein the elements and features of the embodiments are designated by numerals throughout.

Illustrated in FIGS. 1-12 are several representative embodiments of a self-balancing locking mechanism for doors, which embodiments also include various methods for actuating a locking pin-bar assembly of a door to engage with a door frame. As described hereinbelow, the self-balancing locking mechanism provides several significant advantages and benefits over other door locking mechanisms and methods. However, the recited advantages are not meant to be limiting in any way, as one skilled in the art will appreciate that other advantages may also be realized upon practicing the invention.

Figure 1:
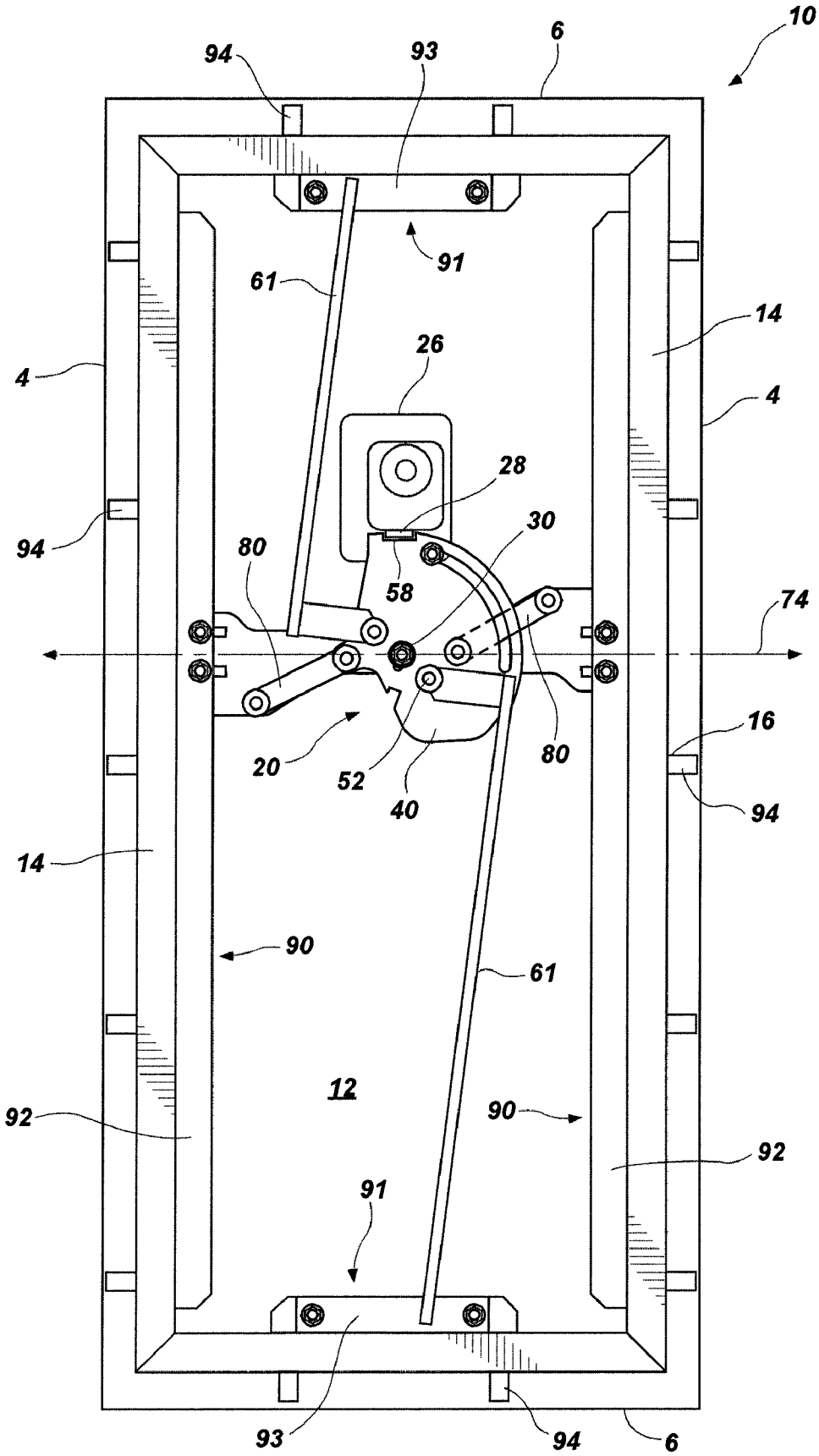
FIG. 1 illustrates a self-balancing locking mechanism for a door positioned in an extended and locked position, in accordance with a representative embodiment.
Figure 2:
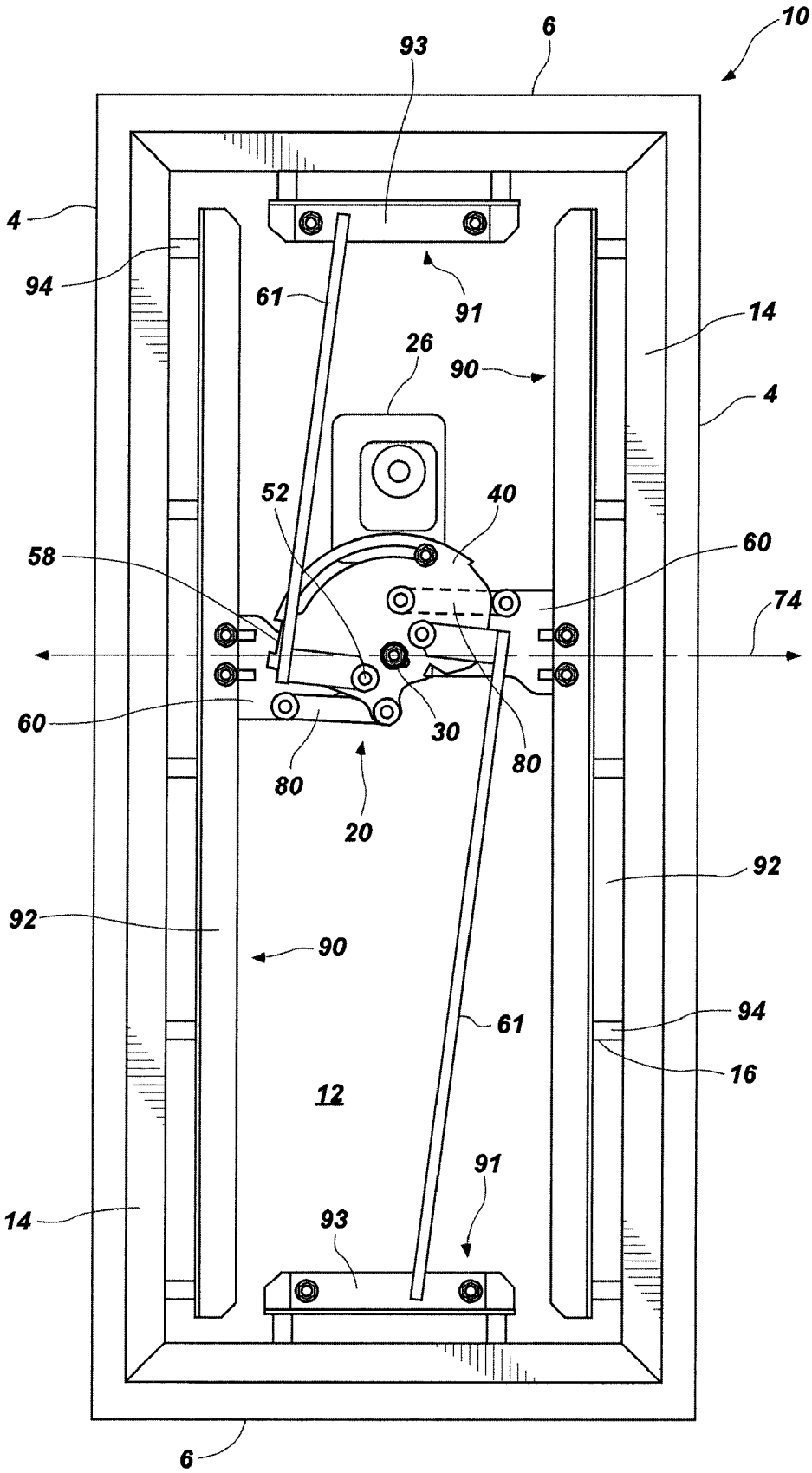
FIG. 2 illustrates the locking mechanism of FIG. 1 positioned in a retracted and unlocked position.

FIGS. 1 and 2 shows a self-balancing locking mechanism 20, in accordance with one representative embodiment. The locking mechanism can be mounted to the inside surface of a door 10 of a security enclosure or safe. The door 10 can have a perimeter frame 14 adjacent the outer side edges 4, 6 of the door which provide both structural support for the door panel 12 and attachment points for hinges which can attach the door to the body of the safe or security enclosure. The perimeter frame 14 and panel 12 of the door can be configured to fit tightly within the door frame (not shown) of the security enclosure or safe when closed so as to prevent the insertion of objects between the door and the door frame, which could be used to pry the two apart, and to restrict or eliminate the transfer of heat or air between the surrounding environment and the interior of the safe.

The perimeter frame 14 of the door can further include locking pin apertures 16 that are periodically spaced along one or more side edges of the door, and which slidably support the plurality of locking pins 94 extending from the pin-bar assemblies 90, 91. As shown in FIG. 1, for example, each horizontally-actuated pin-bar assembly 90 that is located adjacent a vertical side edge 4 of the door 10 can include five locking pins 94 which extend outwardly from the vertically-oriented pin bar bracket 92. Similarly, each vertically-actuated pin bar assembly 91 that is located adjacent a horizontal side edge 6 of the door 20 includes two locking pins 94 which extend outwardly from the horizontally-oriented pin bar bracket 93. Other locking mechanism configurations having different pin-bar assembly arrangements with fewer or alternatively-designed pin-bar brackets and a varying number of locking pins extending therefrom are also possible, and are considered to fall within the scope of the present invention.

The depth of the perimeter frame 14 of the door 10 relative to the door frame of the safe or security enclosure can be arranged so that the locking pins 94 are located interior to an inside perimeter side edge (not shown) of the door frame when the door 10 is in the closed position. As will be understood by one of skill in the art, actuating the pin-bar assemblies 90, 91 with the locking mechanism 20 can extend the locking pins radially outward behind the inside perimeter side edge of the door frame to lock the safe and prevent the door from opening The locking mechanism 20 includes a drive shaft 30 that is mounted to or through the door and which has an axis of rotation, and a cam 40 that is mounted to the drive shaft in an orientation that is substantially-perpendicular to the axis of rotation, so that rotation of the drive shaft causes rotation of the cam. The locking mechanism also includes one or more actuator plates 60, with each actuator plate having a proximal end (e.g. closest to the axis of rotation) with a radial slot formed therein and installed about the drive shaft (hidden behind the cam in FIG. 1), and a distal end that is coupled to the locking pin bar assembly 90 which is slidably supported adjacent the outer side edge 4 of the door 10 by the door's perimeter frame 14, as described above.

The locking mechanism 20 further includes one or more linkage bars 80 which serve as the driving connection between the cam 40 and the actuator plate(s) 60. The linkage bars have a proximal end (e.g. closest to the axis of rotation) that is pivotably coupled to the cam at a radial distance from the axis of rotation, and a distal end that is pivotable coupled to a mid-span of the actuator plate 60, at a point between the radial slot at one end and one or more attachment slots are the other end. The pivoting connections at both ends of the linkage bar 80 can be formed either by smooth-surfaced journal pins extending from the linkage bar and inserted into journal holes in the cam or actuator plates, or by journal holes formed into the linkage bar which receive journal pins mounted to and extending from the coupled components.

The rotation of the drive shaft 30 and cam 40 causes the linkage bars 80 to drive the actuator plates 60 along a horizontal radial axis 74 and to engage or disengage the pin-bar assemblies 90 with the inside perimeter edge of the door frame. Illustrated in FIG. 1, for instance, is the locking mechanism 20 with the cam 40, linkage bars 80, and actuator plates 60 in an extended and locked position, while the same locking mechanism components are shown in a retracted and un-locked position in FIG. 2. In a comparison of the two figures it can be seen that, in addition to the rotational movement of the cam around the axis of rotation of the drive shaft 30, the linkage bars 80 have also moved from a substantially-horizontal and unlocked position in FIG. 2 to the locked positions in FIG. 1 that are both linearly displaced outwardly and substantially-angled.

The linkage bar 80 converts the rotational motion of the cam 40 into the linear motion of an actuator plate 60. Moreover, in response to the driving forces applied by the linkage bar, the actuator plate's linear movement follows the path of a partial cycloid, with the maximum linear motion per degree of rotation occurring when the longitudinal axis of the linkage bar is orientated tangentially with respect to the cam (e.g. FIG. 2).

As will be appreciated by one of skill in the art, with both ends of the linkage bars 80 being free to rotate about their respective pivot journals, a driving force initiated from the cam 40 can only be transmitted to the actuator plates 60 along the length (e.g. along the longitudinal axes) of the linkage bars, with the resulting applied load vectors having an angle to the horizontal radial axis 74. Thus, in addition to the on-axis forces or loads which linearly displace the pin-bar assemblies along the horizontal radial axis 74, there can also be significant off-axis forces or transverse loads applied to the actuator plates 60 by the linkage bars 80. This can be especially pronounced when the linkage bars are orientated at a substantial angle to the horizontal radial axis 74, such as when the locking mechanism 20 is in a more-extended and locked position (see FIG. 1). With the self-balancing locking mechanism 20 described herein, the radial slots in the proximal ends of the actuator plates 60 are caused to bear onto the outer surface of the drive shaft 30 during the movement of the actuator plates to balance the off-axis or transverse loads and resulting moments.

Consequently, the interconnections between the principle components of the locking mechanism 20, namely between the drive shaft 30 and the cam 40, between the cam 40 and the linkage bars 80, between the linkage bars 80 and the actuator plates 60, and between the actuator plates 60 and both the drive shaft 30 and to the pin bar assemblies 90, can create a load-sharing configuration which self-balances any off-axis loads and resulting moments created during conversion of the rotational motion of the drive shaft into linear motion of the pin-bar assembly. This can advantageously result in a smoother and more-efficient mechanical motion of the locking mechanism 20 as the safe door is locked and unlocked.

Also shown in FIGS. 1 and 2, in one aspect the locking mechanism 20 can also include one or more vertically-orientated actuation bars 61 which have a proximal end (e.g. closest to the axis of rotation) that are pivotably coupled to actuation pins 52 that extend axially-outward from the cam 40. The distal ends of the actuation bars are coupled to the horizontally-orientated pin-bar assemblies 91 which are slidably supported adjacent the outer horizontal edges 6 of the door 10 by the door's perimeter frame 14, as described above. The pin-bar assemblies 91 can thus engage a horizontal portion of the inside perimeter side edge of the door frame, such as a top side edge or a bottom side edge, to provide additional support in securing the door to the safe or security enclosure.

Because the horizontally-orientated pin-bar assemblies 91 which engage a top or bottom portion of the door frame are typically shorter in length, support fewer locking pins 94 and thus create smaller loads than the vertically-orientated pin-bar assemblies which engage the side edges of the door frame, these smaller pin-bar assemblies may be actuated with a less-complex actuation pin 52/actuation bar 61 mechanism to reduce the cost and complexity of the overall locking mechanism 20. However, nothing should be construed from the embodiment illustrated in FIGS. 1 and 2 that the drive shaft 30 to-cam 40 to linkage bar 80 to actuator plate 60 configuration of the self-balancing locking mechanism 20 is limited only to the actuation of the left and right side pin-bar assemblies, and the self-balancing configuration may also be applied along the vertical radial axis that intersects the axis of rotation of the drive shaft 30, if so desired.

Once the door of the security enclosure is closed and the cam 40 of the locking mechanism 20 has been rotated to extend the one or more pin-bar assemblies 90, 91 radially outward to engage with the inside perimeter edge of the door frame, the locking mechanism can be secured in its locked rotational position (FIG. 1) with a secondary locking device 26 mounted adjacent the locking mechanism. The secondary locking device 26 can be operated from the front of the door 10 using a key, a mechanical combination device or an electronic combination device, etc., to extend a locking bolt 28 that operates to prevent the locking mechanism 20 from moving or rotating. In the representative embodiment 20 shown in FIGS. 1 and 2, for example, the locking bolt 28 can be extended into a bolt notch 58 formed into the perimeter of the cam 40, to prevent the cam from rotating towards the unlocked position (FIG. 2) and withdrawing the pin-bar assemblies. However, other configurations or locations for the secondary locking device 26, the locking bolt 48 and the bolt notch 58 are also possible, and can be considered to fall within the scope of the present invention. For instance, relocating the secondary locking device so that the locking bolt interacts with a notch formed into one or more actuator plates would also operate to secure the locking mechanism 20 in its locked rotational position (FIG. 1).

Figure 3:
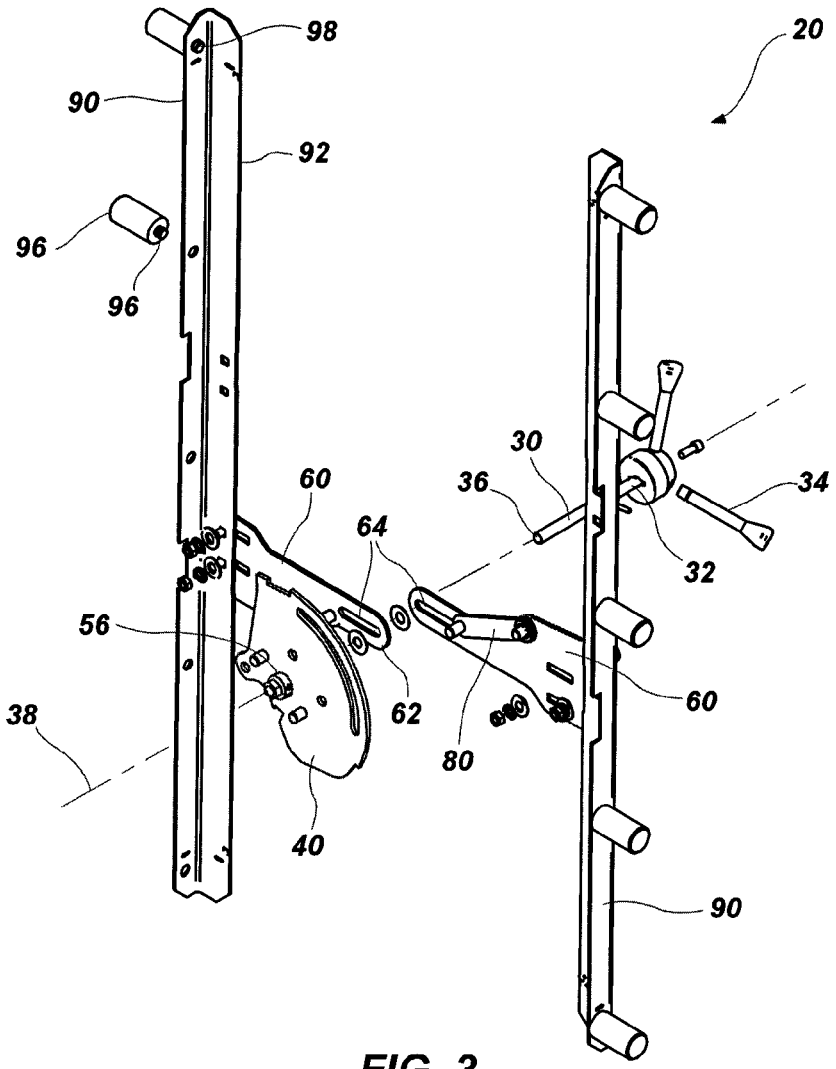
FIG. 3 is an exploded assembly view of the locking mechanism of FIG. 1.

Additional details of the representative locking mechanism 20 of FIGS. 1-2 are illustrated in the exploded assembly view provided in FIG. 3. For example, the drive shaft 30 has an axis of rotation 38, and can include a distal end 32 which projects outwardly through the front of the door panel (not shown), and which can be coupled to a manually-operated door handle 34 used to operate the locking mechanism. Means for rotating the drive shaft other than a manually-operated handle, such electrical, mechanical, hydraulic or pneumatic actuators, etc., are also contemplated. The proximal end 36 of the drive shaft 30 can be coupled to the cam 40 with a coupling device 56 such as an annular bracket and set screw, a threaded screw clamp, or a break-away clutch device, etc. As described above, the drive shaft may also be installed through the radial slots 64 formed into the proximal ends 62 of the actuator plates 60.

The actuator plates 60, linkage bars 80 and horizontally-actuated pin-bar assemblies 90 are also shown in FIG. 3. In one aspect the locking pins 94 can have integral protrusions or buck-tails 96 configured for insertion through holes in the pin-bar brackets 92. After insertion the buck-tails can be cold worked in a peening process, such as with an orbital peening machine, to form an integral rivet head 98 that secures the locking pin to the pin-bar bracket 92. Alternatively, the locking pins 94 can be attached to the pin-bar bracket 92 using an integrally-threaded joint, adhesives, brazing, welding, bolts, screws or other similar fastener devices and methods, etc.

Figure 4A:
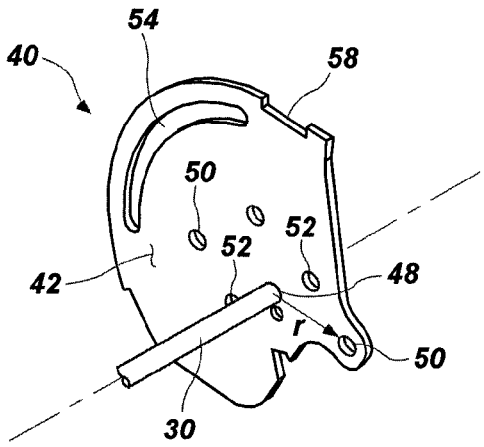
FIGS. 4*a* and 4*b* together illustrate the front and backside of a cycloidal cam, in accordance with the embodiment of FIG. 1.
Figure 4B:
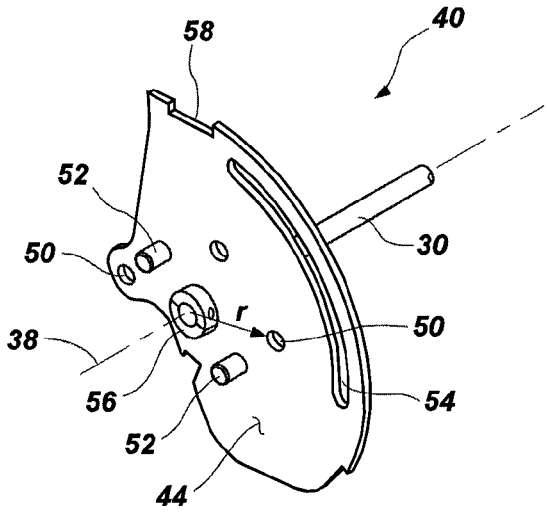

The frontside face 42 and backside face 44 of the cam 40 are shown in FIGS. 4*a* and 4*b*, respectively, with the "frontside" face 42 of the cam being referenced to the front of the door of the security enclosure or safe. As illustrated, the drive shaft 30 can be inserted through a drive shaft hole 48 in the cam from the front side, and secured with a coupling device 56 mounted to the backside face 44, such as with the annular bracket with set screw shown in FIG. 4*a*, so as to allow more clearance for the linkage bars and actuator plates which are attached to or suspended adjacent the frontside face 42. Diametrically-opposed journal holes 50 for journal pins extending from the proximal ends of the linkage bars can be formed at a radial distance r from the axis of rotation 38, while diametrically-opposed actuator pins 52 for the vertical actuator bars can extend axially from the backside face at a similar or different radial distance. As may be appreciated by one of skill in the art, the arrangement of journal holes and projecting pins on the cam 40 may be modified or even reversed, so long as the connections to the cam for both the linkage bars and for the vertical actuator bars are pivoting connections.

An arc-segment slot 54 can also be formed adjacent a perimeter edge of the cam 40 for receiving a stationary pin 18 (see FIGS. 8-10) that is fixed to the door panel or to a non-moving portion of the locking mechanism or secondary locking device. As will be described in more detail below, the arc-segment slot and stationary pin can together provide a rotational stop for the cam, in one or both directions, to prevent the over-rotation or uncontrolled linear travel of the various moving parts of the locking mechanism 20. In one aspect the arc-segment slot can include an arc length of about eighty degrees, thus allowing the cam to rotate about eighty degrees between the locked and unlocked positions. In other aspects the arc length of the arc-segment slot can range from about forty-five degrees to about ninety degrees.

The stationary pin can have an expanded head which, together with the sides of the arc-segment slot 54 can provide a second axial support for the cam (in addition to the drive shaft itself), and can operate to hold the cam in its correct axial position and prevent the bolt notch 58 of the cam 40 from being axially dislodged from the locking bolt during an assault or attempted break-in on the safe.

Figure 5:
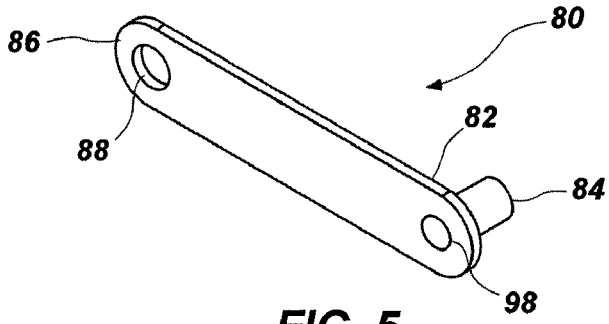
FIG. 5 is a perspective view of a linkage bar, in accordance with the embodiment of FIG. 1.

FIG. 5 illustrates a linkage bar 80 which converts the rotational motion of the cam into the linear motion of the actuator plate. Pivotably supported at both ends, the linkage bar can have a journal pin 84 attached at the proximal end 82 of the linkage bar for insertion into one of the journal holes formed into the cam, and a distal-end journal hole 88 formed into the distal end 86 for receiving a journal pin extending from the actuator plate. As stated above, however, the arrangement of journal holes and journal pins may be modified or reversed if so desired, so long as the linkage bar 80 is pivotably coupled to the cam at the proximal end and pivotably coupled to the actuator plate at the distal end.

Figure 6:
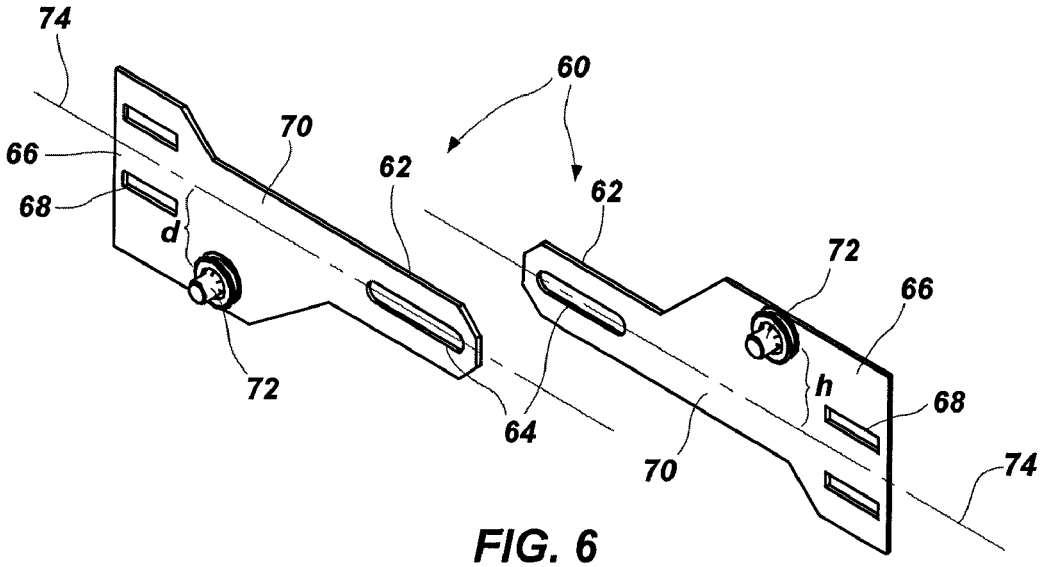
FIG. 6 is a perspective view of a set of actuator plates, in accordance with the embodiment of FIG. 1.

An isolated pair of actuator plates 60 is shown in FIG. 6. Each actuator plate 60 has a lateral or radial slot 64 formed into the proximal end 62 thereof. The drive shaft of the locking mechanism is inserted through both radial slots during assembly, and the actuator plates are slightly offset along the axis of rotation from each other so that the proximal ends can overlap during operation of the apparatus. Additionally, a linkage bar journal pin 72 is installed in a mid-span location 70 of the actuator plate to provide a pivoting connection with the distal end of the linkage bar. In one aspect the location of the mid-span journal pin 72 can be vertically offset from the horizontal radial axis 74 a short distance h that approximates the radius of the journal holes for the linkage bar in the cams, so that the linkage bar is substantially horizontal when the cam is rotated to the open and unlocked position (see FIG. 2). This representative configuration can provide a user with the greatest leverage or mechanical advantage in overcoming the various friction and inertial loads that are inevitably present in the locking mechanism when first starting to move the apparatus from a retracted and resting position. Other locations on the actuator plate 60 for the mid-span journal pin 72 are contemplated, and may also be considered to fall within the scope of the present invention.

Each of the actuator pins 52 extending from the cam 40 (FIG. 4*a*) and the journal pins 84, 72 extending from the linkage bars and actuator plates, respectively (FIGS. 5 and 6), can be attached to their respective base structures with an integral rivet head 98 (see FIG. 5) formed using the same procedure for coupling the locking pins to the pin-bar brackets described above, and which can include the orbital peening process described above. Alternatively, the actuator and journal pins can be attached to their respective base structures using an integrally-threaded joints, adhesives, brazing, welding, bolts, screws or other similar fastener devices and methods, etc.

Figure 7:
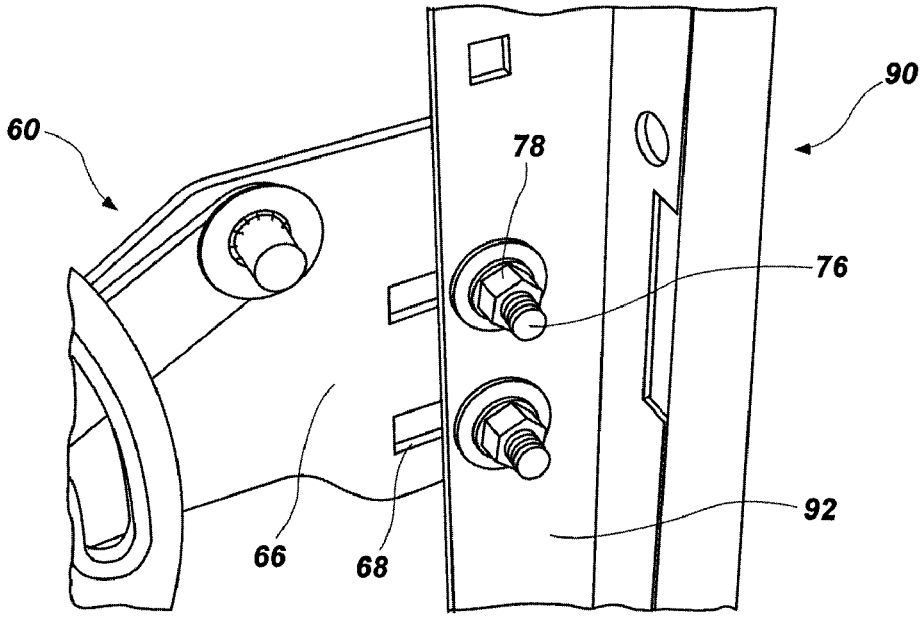
FIG. 7 is a perspective view of a distal end of an actuator plate connected to a pin-bar assembly, in accordance with the embodiment of FIG. 1.

As illustrated in both FIGS. 6 and 7, a pair of horizontal attachment slots 68 can be formed into the distal ends 66 of the actuator plates to provide for the adjustment of the actuator plates 60 relative to the pin-bar assembly 90. For instance, the slotted distal ends 66 of the actuator plates may be coupled to the pin-bar brackets 92 with attachment bolts 76 and nuts 78, or similar fastening system, which allows for the lateral (e.g. horizontal) and the angular adjustment of the pin-bar bracket relative to the actuator plate. Slight off-axis (e.g. vertical) adjustment may also be facilitated when the attachment slots 68 are greater in width than the diameter of the attachment bolts 76.

Figure 8:
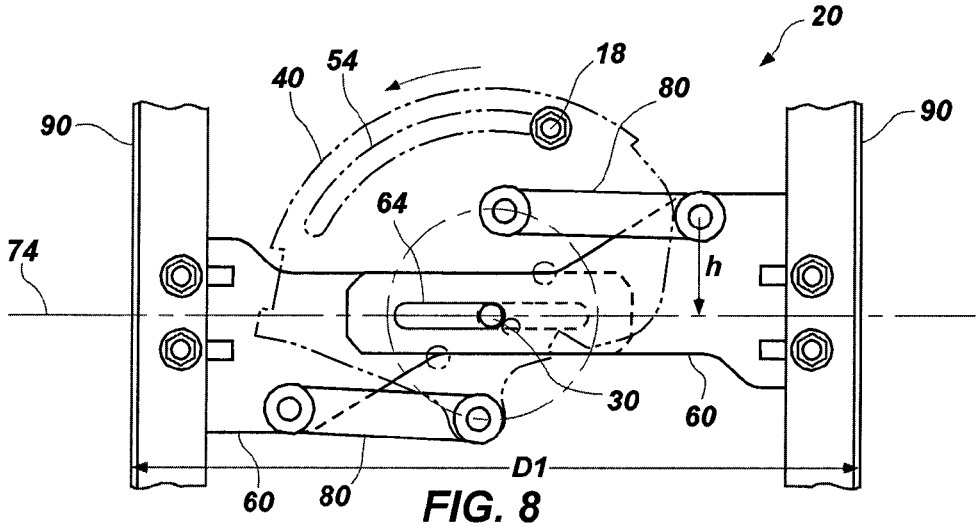
FIG. 8 is a close-up schematic view of the locking mechanism of FIG. 1 in the retracted and unlocked position.
Figure 9:
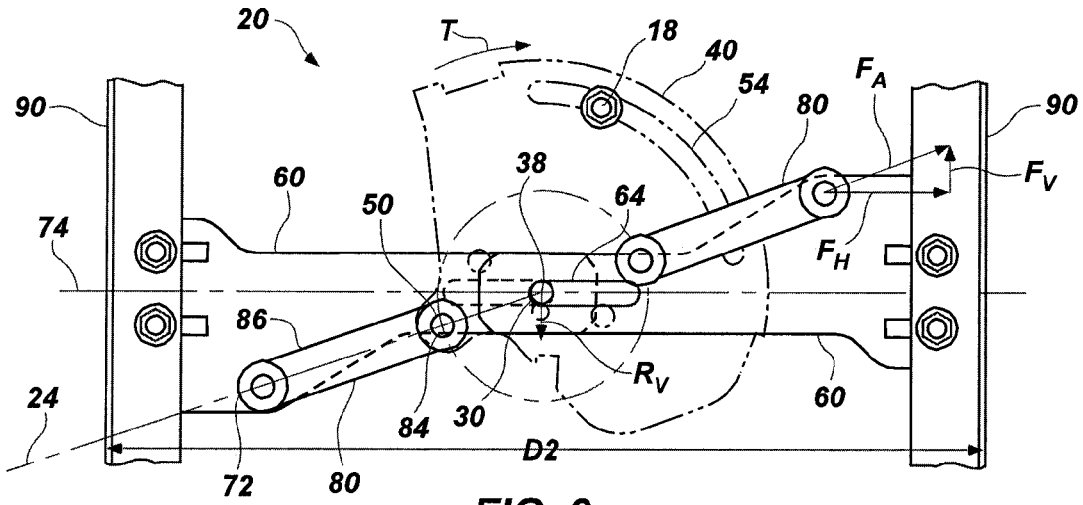
FIG. 9 is a close-up schematic view of the locking mechanism of FIG. 1 in the centered and fully-extended position.
Figure 10:
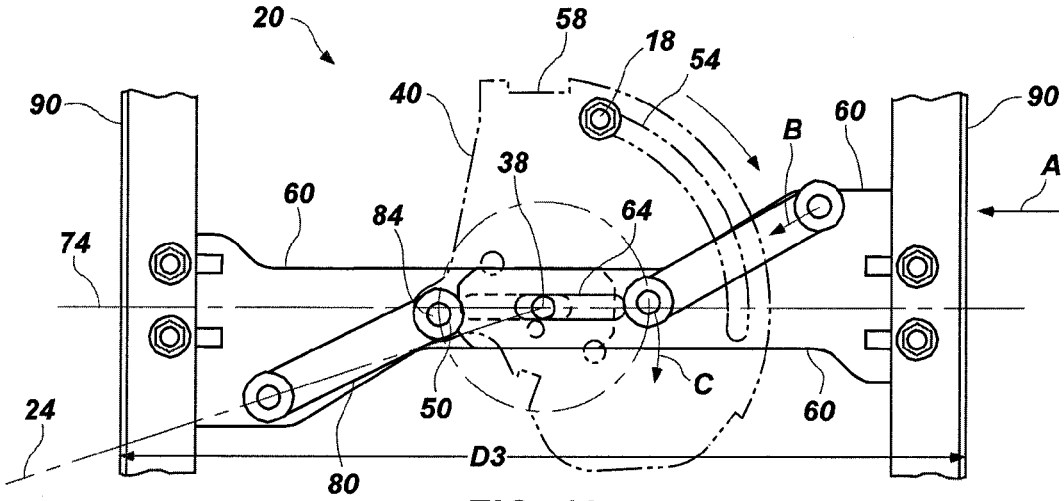
FIG. 10 is a close-up schematic view of the locking mechanism of FIG. 1 in the over-centered and partially-retracted locked position.

FIGS. 8-10 illustrate the interaction between the various components of the locking mechanism 20 during movement from a fully-retracted open position (FIG. 8), through a fully-extended intermediate position (FIG. 9), to a partially-retracted and over-centered locked position (FIG. 10). In addition to the self-balancing of each individual linkage bar 80/actuator plate 60 sub-assembly in the vertical direction, the locking mechanism 20 can also provide for an overall internal-balancing of forces with a configuration that includes two actuator plates 60 driven in opposite directions by two linkage bars 80 to engage a pair of locking pin-bar assemblies 90 with opposite vertical side edges of the door frame.

Referring now to FIG. 8, the cam 40 is rotated to its furthest counter-clockwise position (as viewed from the back the door), so that the stationary pin 18 is abutted against one end of the arc-segment slot 54. Thus, in one aspect the contact interface between the stationary pin 18 and the cam 40 may form a rotational stop that prevents the cam from rotating further in the counter-clockwise direction, and from pulling the pin-bar assemblies 90 so far inward that the locking pins slip out of the locking pin apertures in the perimeter frame that supports of the pin-bar assemblies. In addition, the inner ends of the radial slots 64 formed into the actuator plates 60 can also be configured to abut against the drive shaft 30 with the cam 40 in its furthest counter-clockwise position (and with the proximal ends 62 of the actuator plates overlapping to the greatest degree) to provide additional protection from over-rotation and possible damage or dislodgment of the locking mechanism components. With the locking mechanism 20 in its fully-retracted and open position, as shown in FIG. 8, the distance D1 between the two pin-bar assemblies 90 is at its smallest value.

From the un-locked position of FIG. 8, the drive shaft 30 and cam 40 can be rotated in the clockwise direction with the application of torque T until the proximal-end linkage bar journal pins 84 inserted into the journal holes 50 in the cam are aligned with a radial reference line 24 extending from the axis of rotation 38 to the mid-span journal pins 72 supporting the distal ends 86 of the linkage bars 80, as illustrated in FIG. 9. At this intermediate point in the range of movement of the locking mechanism 20, the actuator plates and attached pin-bar assemblies are in their fully-extended positions and the distance D2 between the two pin-bar assemblies 90 is at its greatest value. Although the stationary pin 18 has not reached the other end of the arc-segment slot 54, the outer ends of the two radial slots 64 formed into the actuator plates 60 are now adjacent the drive shaft, and can be provided with clearance sufficient to allow the continued rotation of the drive shaft and cam in the clockwise direction.

As can also be seen in FIG. 9, the torque T being applied to the drive shaft and cam can be transformed by the translating and pivoting linkage bar 80 into an applied force $F_A$ on the mid-span journal pins 72 extending from the actuator plates 60. Since the journal pin is a freely-pivoting connection which cannot transmit an applied moment, the actuator plate 60 receives both the horizontal force component $F_H$ and the vertical force component $F_V$. The horizontal force component $F_H$ is used to drive the pin-bar assemblies 90 back and forth along the horizontal radial axis 74. If left unchecked, the vertical (or off-axis) force component $F_V$ would also be transmitted to the pin-bar assemblies and have the affect of pushing the plurality of locking-pins against the apertures in the door's perimeter frame and generating excess friction and drag which must be overcome by the user imparting additional torque to the locking mechanism.

To avoid this undesirable interaction, the locking mechanism 20 can be configured so that the vertical (or off-axis) force component $F_V$ applied to the actuator plate by the linkage bar causes the radial slots 64 in the proximal ends of the actuator plate 60 to instead bear on the drive shaft 30 and create a vertical reaction force $R_V$ that counteracts and self-balances the off-axis load $F_V$ before it can be transferred to the door's perimeter frame. Consequently, the excess friction and drag resulting from an unbalanced off-axis load are avoided, and the locking mechanism 20 operates smoothly and with a minimum of applied torque.

Although illustrated and described in reference to FIG. 9 (e.g. with the journal pins 72, 84 being radially aligned and the locking mechanism 20 in the fully-extended position), the self-balancing features created by the radial slots 64 can be provided when the drive shaft 30 and cam 40 are in any rotational position. Furthermore, as can be appreciated by one of skill in the art, a locking mechanism 20 that includes two actuator plates 60 driven in opposite directions by two linkage bars 80 to engage a pair of locking pin-bar assemblies 90 with opposite vertical side edges of the door frame (as with the dual-actuation configuration illustrated in FIGS. 1-10) can be further balanced internally, since the vertical reaction forces $R_V$ which counteract and self-balance the off-axis loads $F_V$ applied to each actuator plate 60 are themselves cross-canceled and balanced across the drive shaft. Moreover, since the horizontal force components $F_H$ can also be balanced with a dual-actuation configuration, the representative embodiment 20 of the locking mechanism described herein can be extremely smooth and efficient when compared with other door locking mechanisms and methods.

As will be apparent to one of skill in the art, the rotational designations of counter-clockwise to retract the actuator plates 60 and pin-bar assemblies 90 and clockwise to extend the components are arbitrary, and that the operational direction of the locking mechanism 20 and configuration of the internal components are reversible.

Illustrated in FIG. 10 is yet another beneficial aspect of the locking mechanism 20, in which the proximal-end linkage bar journal pins 84 inserted into the journal holes 50 in the cam can be rotated beyond the radial reference line 24 extending from the axis of rotation 38 to the journal pins 72 coupled to distal ends 86 of the linkage bars 80. This has the affect of withdrawing the pin-bar assemblies a pre-determined over-center retract distance from a fully-extended position shown in FIG. 9, so that the value of the distance D3 between the two pin-bar assemblies 90 is D2 minus the over-center retract distance.

Over-rotating the cam 40 beyond the fully-extended position can create a positive lock on the side locking door pins and provide the locking mechanism with greater punch-resistance. For instance, if an externally-applied punch force A is directed against the pin-bar assembly 90, the reaction force B that is transmitted through the linkage bar 80 to the cam 40 can create a rotational moment C that causes the cam to rotate further in the clockwise direction, if possible, so that the stationary pin 18 is abutted against the end of the arc-segment slot 54 if it has not already reached that position. Thus, the stationary pin in the arc-segment slot and the locking bolt in the bolt slot 58 can operate together to hold the cam in position, resist the assault on the safe, and prevent the pin-bar assemblies from being forced radially inward to unlock the door.

In one aspect the over-center retract distance can range from about ten percent to about twenty percent of the total linear movement of the actuator plate. For instance, in one exemplary embodiment the total linear movement of the actuator plate and the pin-bar assemblies from the fully-retracted position in FIG. 8 to the fully-extended position in FIG. 9 (e.g. D2-D1) can be about 2.125 inches, while the retract distance illustrated in FIG. 10 (e.g. D2-D3) can be about 0.323 inches.

Figure 11:
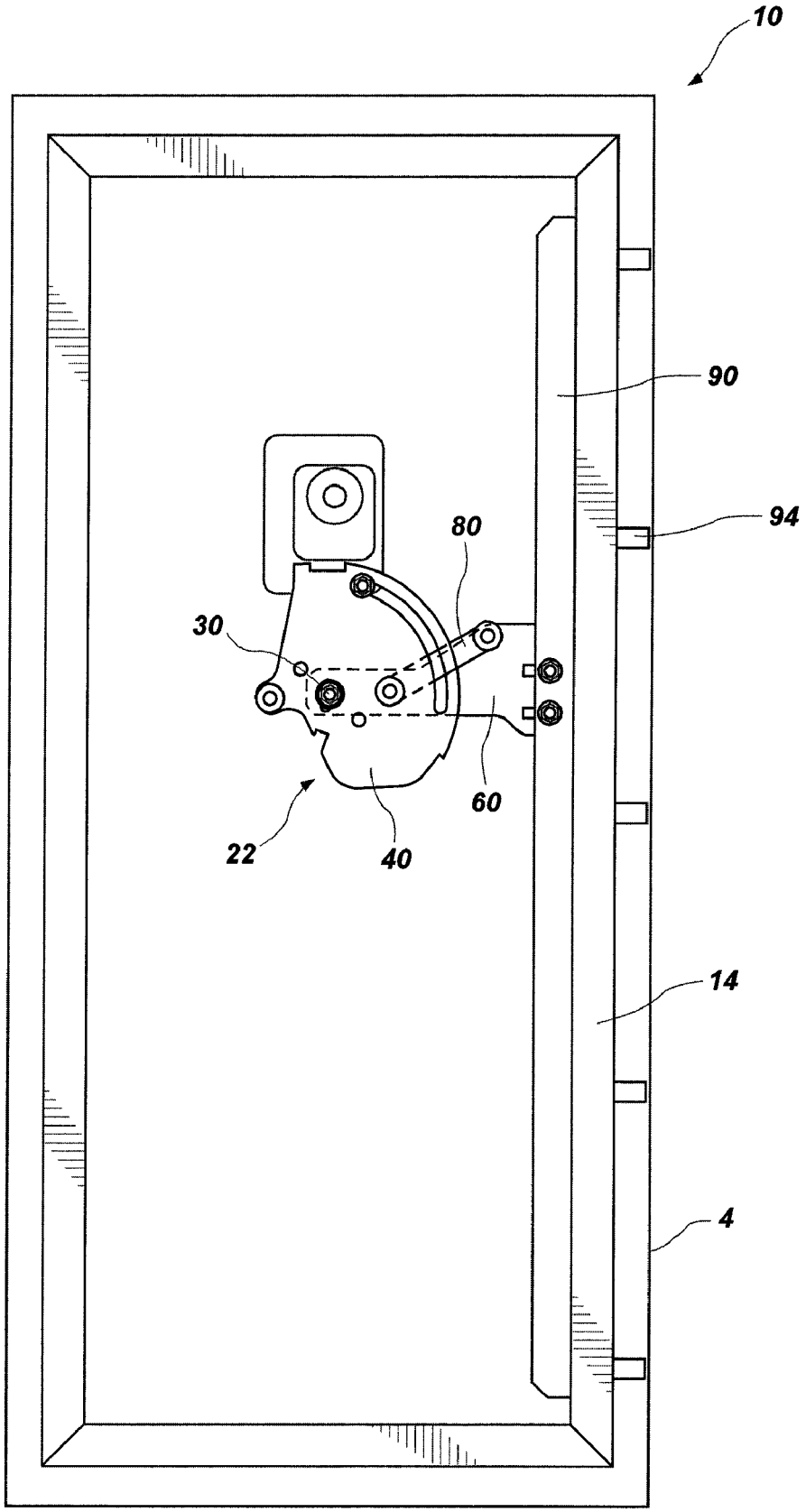
FIG. 11 illustrates a self-balancing locking mechanism for a door positioned in an extended and locked position, in accordance with another representative embodiment.

In accordance with another yet representative embodiment, FIG. 11 illustrates a single-sided, self-balancing locking mechanism 22 for a door 10 of a security enclosure or safe that is positioned in an extended and locked position. Similar to the apparatus described above, the locking mechanism 22 includes a drive shaft 30, a cam 40, a single actuator plate 60 driving a pin-bar assembly 90, and a single linkage bar 80. The pin-bar assembly 90 can be supported within an perimeter frame 14 adjacent the side edge 4 of the door, and can be configured to interface with an inside perimeter edge (not shown) of the door frame when the door 10 is in the closed position. Actuating the pin-bar assemblies 90 with the locking mechanism 22 can extend the locking pins 94 radially outward behind the inside perimeter edge of the door frame to lock the security enclosure and prevent the door from opening. Moreover, the locking mechanism 22 can also provide for the self-balancing of the single linkage bar 80/actuator plate 60 sub-assembly in the vertical direction for smoother operation.

Although the pin bar bracket 92 illustrated in FIG. 11 extends substantially along the entire height of the door 10 and includes five locking pins 94, the single-sided locking mechanism 22 may include a shorter pin-bar bar bracket and fewer locking pins so as to reduce the cost and complexity of the locking mechanism. Thus, one application for the single-sided locking mechanism 22 can include safes, safety enclosures, rooms, closets and facilities which require additional security and protection beyond that provided by traditional door locking mechanisms, but which have not risen to the level of the dual-actuation embodiment illustrated and described above with reference to FIGS. 1 and 2, and which can lock against two or more sides of the door frame.

Figure 12:
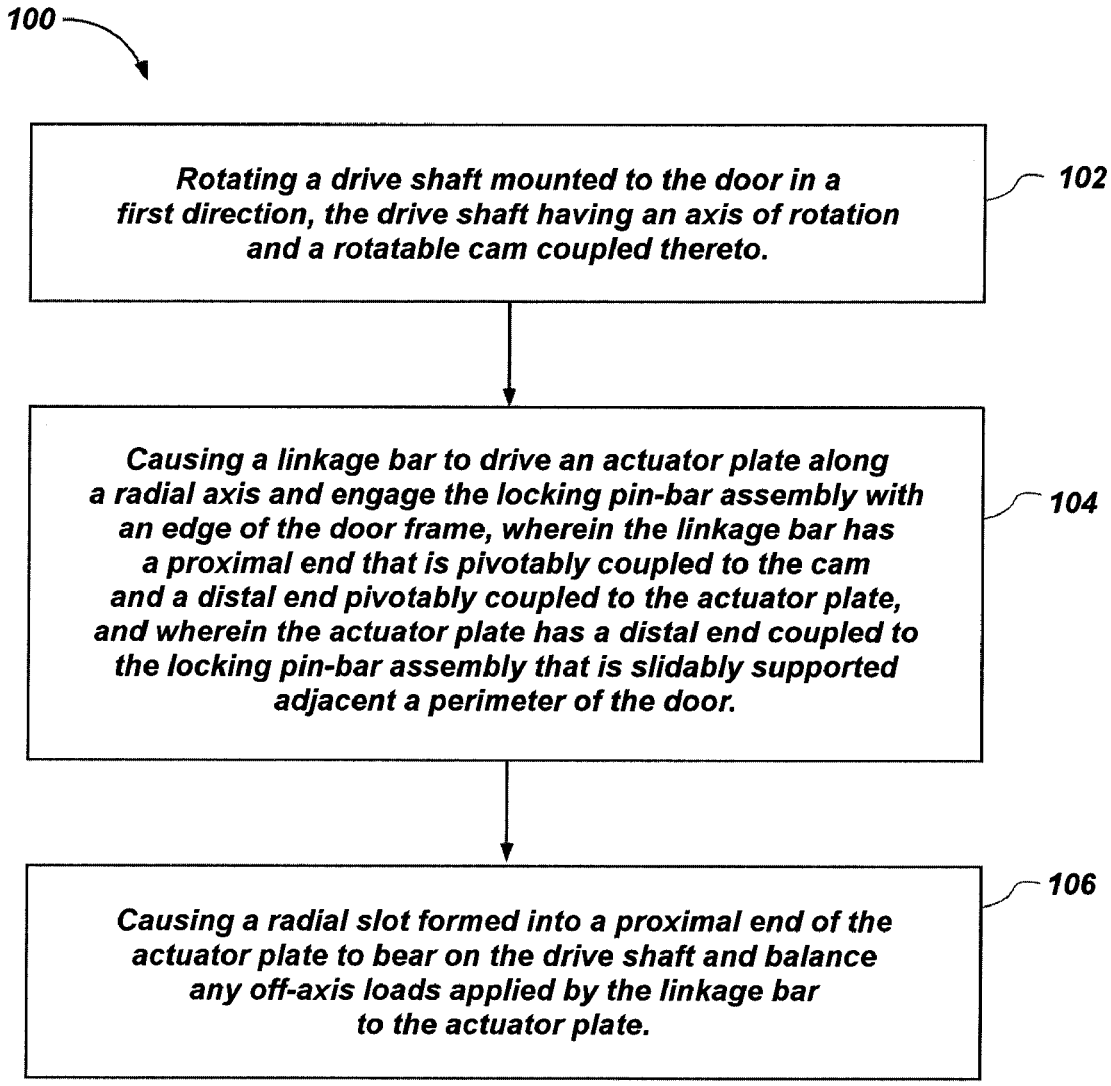
FIG. 12 is a flowchart depicting a method for actuating a locking pin-bar assembly of a door to engage with a door frame, in accordance with yet another representative embodiment.

FIG. 12 is a flowchart depicting a method 100 for actuating a locking pin-bar assembly of a door to engage with a door frame, in accordance with yet another representative embodiment. The method 100 includes the step of rotating 102 a drive shaft mounted to the door in a first direction, the drive shaft having an axis of rotation and a rotatable cam coupled thereto. The method also includes the step of causing 104 a linkage bar to drive an actuator plate along a radial axis and engage the locking pin-bar assembly with a side edge of the door frame, wherein the linkage bar has a proximal end that is pivotably coupled to the cam and a distal end pivotably coupled to the actuator plate, and wherein the actuator plate has a distal end coupled to the locking pin-bar assembly that is slidably supported adjacent a perimeter of the door. The method 100 further includes the step of causing 106 a radial slot formed into a proximal end of the actuator plate to bear on the drive shaft and balance any off-axis loads applied by the linkage bar to the actuator plate.

The foregoing detailed description describes the invention with reference to specific representative embodiments. However, it will be appreciated that various modifications and changes can be made without departing from the scope of the present invention as set forth in the appended claims. The detailed description and accompanying drawings are to be regarded as illustrative, rather than restrictive, and any such modifications or changes are intended to fall within the scope of the present invention as described and set forth herein.

More specifically, while illustrative representative embodiments of the present invention have been described herein, the invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, any steps recited in any method or process claims, furthermore, may be executed in any order and are not limited to the order presented in the claims. The term "preferably" is also non-exclusive where it is intended to mean "preferably, but not limited to." Accordingly, the scope of the invention should be determined solely by the appended claims and their legal equivalents, rather than by the descriptions and examples given above.

What is claimed and desired to be secured by Letters Patent is:

1. A self-balancing locking mechanism for actuating a locking pin-bar assembly of a door, comprising:

a drive shaft mounted to the door and having an axis of rotation;

a cam mounted to the drive shaft;

at least one actuator plate having a proximal end with a radial slot formed therein and installed about the drive shaft, and a distal end coupled to the locking pin-bar assembly that is slidably supported adjacent a perimeter of the door; and at least one linkage bar having a proximal end pivotably coupled to the cam at a radial distance from the axis of rotation, and a distal end pivotably coupled to a mid-span of the actuator plate, wherein rotation of the cam causes the linkage bar to drive the actuator plate along a radial axis and engage the locking pin-bar assembly with a side edge of a door frame, and the radial slot to bear on the drive shaft and balance off-axis loads applied by the linkage bar to the actuator plate.

2. The locking mechanism of claim 1, wherein the radial axis is a horizontal radial axis intersecting the axis of rotation of the drive shaft and the locking pin-bar assembly engages a vertical side edge of the door frame.

3. The locking mechanism of claim 2, wherein the distal end of the linkage bar is coupled to the mid-span of the actuator plate at a distance vertically-offset from the horizontal radial axis.

4. The locking mechanism of claim 2, further comprising first and second actuator plates being driven in opposite directions along the horizontal radial axis by first and second linkage bars to engage first and second locking pin-bar assemblies with opposite vertical side edges of the door frame.

5. The locking mechanism of claim 2, further comprising at least one vertically-oriented actuation bar having a proximal end pivotably coupled to the cam and a distal end coupled to an additional locking pin-bar assembly that engages a horizontal side edge of the door frame.

6. The locking mechanism of claim 1, wherein the proximal end of the linkage bar is over-rotated beyond a radial reference line extending from the axis of rotation to the distal end of the linkage bar, and the locking pin-bar assembly is withdrawn a pre-determined over-center retract distance from a fully-extended position.

7. The locking mechanism of claim 6, further comprising a stationary pin installed within an arc-segment slot formed into the cam and limiting the over-rotation of the cam.

8. The locking mechanism of claim 7, wherein the arc-segment slot has an arc length ranging from about forty-five degrees to about ninety degrees.

9. The locking mechanism of claim 1, wherein the door and door frame further comprise a door and a door frame of a safe.

10. An internally-balanced locking mechanism for securing a door of a safe, comprising:

a drive shaft mounted through the door of the safe and having an axis of rotation;

a cam mounted to the drive shaft;

at least two actuator plates, each having a proximal end with a lateral slot formed therein and installed about the drive shaft, and a distal end coupled to opposing locking pin-bar assemblies that are slidably supported adjacent a perimeter of the door of the safe, respectively; and at least two linkage bars, each having a proximal end pivotably coupled to the cam at a radial distance from the axis of rotation, and a distal end pivotably coupled to a mid-span of one of the actuator plates, wherein rotation of the cam causes the linkage bars to drive the actuator plates in opposite directions along a horizontal radial axis and engage the locking pin-bar assemblies with opposite vertical side edges of a door frame of the safe, and the at least two lateral slots bear on the drive shaft and balance off-axis loads applied by the linkage bars to the actuator plates.

11. The locking mechanism of claim 10, wherein the distal end of the linkage bar is coupled to the mid-span of the actuator plate at a vertically-offset distance from the horizontal radial axis.

12. The locking mechanism of claim 10, further comprising at least one vertically-oriented actuation bar having a proximal end pivotably coupled to the cam and a distal end coupled to an additional locking pin-bar assembly that engages a horizontal side edge of the door frame.

13. The locking mechanism of claim 10, wherein the proximal ends of the at least two linkage bars are over-rotated beyond a radial reference line extending from axis of rotation to the distal ends of the linkage bars, and the opposing locking pin-bar assemblies are withdrawn a pre-determined over-center retract distance from a fully-extended position.

14. The locking mechanism of claim 13, further comprising a stationary pin installed within an arc-segment slot formed into the cam and limiting the over-rotation of the cam.

15. The locking mechanism of claim 14, wherein the arc-segment slot has an arc length ranging from about forty-five degrees to about ninety degrees.

16. A method of actuating a locking pin-bar assembly of a door to engage with a door frame, comprising:

rotating a drive shaft mounted to the door in a first direction, the drive shaft having an axis of rotation and a rotatable cam coupled thereto;

causing a linkage bar to drive an actuator plate along a radial axis and engage the locking pin-bar assembly with a side edge of the door frame, wherein the linkage bar has a proximal end pivotably coupled to the cam at a radial distance from the axis of rotation and a distal end pivotably coupled to a mid-span of the actuator plate, and wherein the actuator plate has a distal end coupled to the locking pin-bar assembly that is slidably supported adjacent a perimeter of the door; and causing a radial slot formed into a proximal end of the actuator plate to bear on the drive shaft and balance off-axis loads applied by the linkage bar to the actuator plate.

17. The method of claim 16, further comprising over-rotating the proximal end of the linkage bar beyond a radial reference line extending from the axis of rotation to the distal end of the linkage bar, and withdrawing the locking pin-bar assembly a pre-determined over-center retract distance from a fully-extended position.

18. The method of claim 17, further comprising limiting the over-rotation of the proximal end of the linkage bar with a stationary cam stop.

19. The method of claim 18, wherein the cam stop further comprises a stationary pin having a base fixed to the door and a pin body end positioned within an arc-segment slot formed into the cam.

20. The method of claim 16, further comprising:

rotating the drive shaft mounted to the door in an opposite direction;

causing the linkage bar to pull the actuator plate along the radial axis and disengage the locking pin-bar assembly with the side edge of the door frame, and causing the radial slot to bear on the drive shaft and balance off-axis loads applied by the linkage bar to the actuator plate.

* * * * *